US006417753B1

(12) United States Patent
Wolf et al.

(10) Patent No.: US 6,417,753 B1
(45) Date of Patent: Jul. 9, 2002

(54) PLANAR MAGNETIC DEVICE WITHOUT CENTER CORE LEG

(75) Inventors: Ronald M. Wolf, Geldrop; Pieter J. Van Der Zaag, Waalre, both of (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/506,544

(22) Filed: Feb. 17, 2000

(51) Int. Cl.[7] ..... H01F 17/06
(52) U.S. Cl. ..... 336/182; 336/178; 336/181
(58) Field of Search ..... 336/181–182, 336/178, 198, 155, 160, 165

(56) References Cited

U.S. PATENT DOCUMENTS

| | | | | |
|---|---|---|---|---|
| 3,014,189 A | | 12/1961 | MacKinnon | 336/87 |
| 4,221,750 A | * | 9/1980 | Sprengling | 264/71 |
| 4,943,793 A | | 7/1990 | Ngo et al. | 336/83 |
| 5,598,135 A | | 1/1997 | Maeda et al. | 336/200 |

FOREIGN PATENT DOCUMENTS

| | | | |
|---|---|---|---|
| EP | 0117515 A1 | 9/1984 | H01F/37/00 |
| EP | 0444522 A1 | 9/1991 | H01F/3/14 |
| GB | 2037089 A | 7/1980 | H01F/3/14 |

OTHER PUBLICATIONS

Japanese Abstract, 6–204050(A), "Core Type Reactor with Gap", dated Jul. 22, 1994.

"A Contribution to the Design Optimization of Resonant Inductors for High Power Resonant DC–Dc Converters" Kirchenberger et al, IEEE Oct. 1992, p. 994–1001.

U. Kirchenberger et al, "A Contribution to the Design Optimization of Resonant Inductors for High Power Resonant DC–DC Converters", Proceedings of the Inductry Applications Society Annual Meeting, US,NY, IEEE, vol. –, Oct. 4, 1992, pp. 994–1001, XP000368903.

* cited by examiner

*Primary Examiner*—Anh Mai

(57) ABSTRACT

A planar magnetic device with vertically oriented coil windings having a cross-section of a core with a torroidally-shaped winding structure taken transverse to the plane of the winding structure having two adjacent "winding windows" where the coils are present. One or more gaps in the core materials surrounding the windings store most of the energy generated by the inductor. The gap of height of at least one half the height of the winding structure is confined to the area between the winding cross-sections. Furthermore, in another aspect of the invention the gap is filled with a multi-layer structure of an alternating mono-layer of equally sized ferrite particles and a layer of synthetic resin.

6 Claims, 6 Drawing Sheets

PLANAR MAGNETIC DEVICE WITHOUT CENTER CORE LEG

BACKGROUND OF THE INVENTION

1. Field of the Invention

This invention relates to planar magnetic devices and more specifically to devices that minimize or eliminate the gap related magnetic field deformation in planar gapped magnetic structures.

2. Description of the Background of the Invention

Transformers and inductors are examples of electrical devices that transfer a magnetic or electric state from an electrified body to a proximately located non-electrified body. Many types of such devices are used in computers, telecommunications equipment, control instrumentation, and virtually all-household and commercial electronic equipment. Specifically, magnetic devices may be found as constituents of power systems, resonant filters, and electromagnetic interference (EMI) filters that shield equipment from harmful EMI and reduce EMI emissions.

The use of magnetic inductors is based on their capability to store energy. Energy is stored in a magnetic field generated by an inductor coil. The use of an inductor core permits the magnetic field to be confined and concentrated in a small volume, referred to as the magnetic "gap," where the larger part of the energy is stored.

The use of magnetic devices, transformers in particular, is based on their capability to transfer energy. In many applications it is beneficial to transfer only a part of energy and store the remainder of the energy in the transformer. The use of a core in the transformer permits the magnetic field to be confined and concentrated in the core gap in a way similar to an inductor.

The magnitude and the deformation of the magnetic field generated by the inductor coil close to the gap is referred to as flux fringing around the gap. In all gapped magnetic devices, excited with an alternating current (AC), the inductor coil turns experience a high alternating magnetic field in the area close to the gap. Due to the interaction of the charge carriers and the alternating field, the resulting eddy current losses are relatively high in this area. Eddy current is an electric current induced by an alternating magnetic field.

The traditional solution, in situations where eddy currents become problematic, is the use of the Litz wire. Litz wire consists of a number of separately insulated strands twisted or bunched together such that each strand tends to take all possible positions in the cross section of the entire conductor. This design concept results in the equalizing of the flux linkages and hence reactances of the individual strands, thereby causing the current to divide uniformly between strands. The resistance ratio of the AC to the direct current (DC) then tends to approach unity, which is desirable in all high Quality Factor (Q) circuit applications.

The small wire radius of each of the Litz wire strands results in a drastic reduction of eddy current related losses. Alternatively, the DC resistivity of the coil will increase due to the application requirements. The overall benefit lies in the fact that by going to higher frequencies the required amount of stored energy, and therefore the number of magnetic inductor turns needed, may be decreased. This decreases both the over all volume and the high dissipation of energy in the winding volume close to the gap.

In planar vertically wound magnetic devices; the effects of the gap related eddy current losses have been minimized, resulting in considerably lower winding losses. The method of achieving such eddy current loss decrease, is described and claimed in a co-pending U.S. patent application Ser. No. 08/963,938, filed on Apr. 27, 1999. The disclosure of that patent application describes how shapes of components force the magnetic field close to the winding in the direction perpendicular to the plane of the component and parallel to the flat turns of the winding.

Due to the higher copper fill factor and subsequently a smaller mean turn length, achieved through the use of the foil wound components, the overall energy dissipation is lower than that found in Litz wire wound components. Still, a dissipation enhancement is found close to the inductor gap that is due to flux fringing.

Similarly, in many electronic applications of transformers, energy is stored in the gap of the transformer. A transformer is an electronic component that first transforms electric alternating current to a magnetic field and then transforms the magnetic field in to the electric current. In transformers, due to the resulting fringe fields extending outside the gap regime, eddy currents and thus high dissipation are induced in the windings around the central pole.

The object of the present invention is to minimize or to eliminate energy losses due to gap related magnetic field deformation in electrical devices such as transformers and inductors. This minimization or elimination of energy losses will result in a minimization of the AC losses and higher energy storage.

SUMMARY OF THE INVENTION

The present invention is a planar magnetic component with vertically oriented coil windings having a cross-section of a core with a torroidally-shaped winding structure taken transverse to the plane of the winding structure. The winding structure is having two adjacent "winding windows" where one or more coaxial wound coils are presented. One or more gaps in the core material surrounding the windings store most of the energy generated by the inductor. The gap of height of at least one half the height of the winding structure is confined to the area in the center of the coil-set.

Furthermore, in another aspect of the invention the gap is filled with a magnetic-polymer composite or a multi-layer structure of an alternating mono-layer comprised of equally sized ferrite particles and a layer of synthetic resin.

BRIEF DESCRIPTION OF DRAWINGS

The foregoing objects and advantages of the present invention may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE INVENTION

Figure 1A:
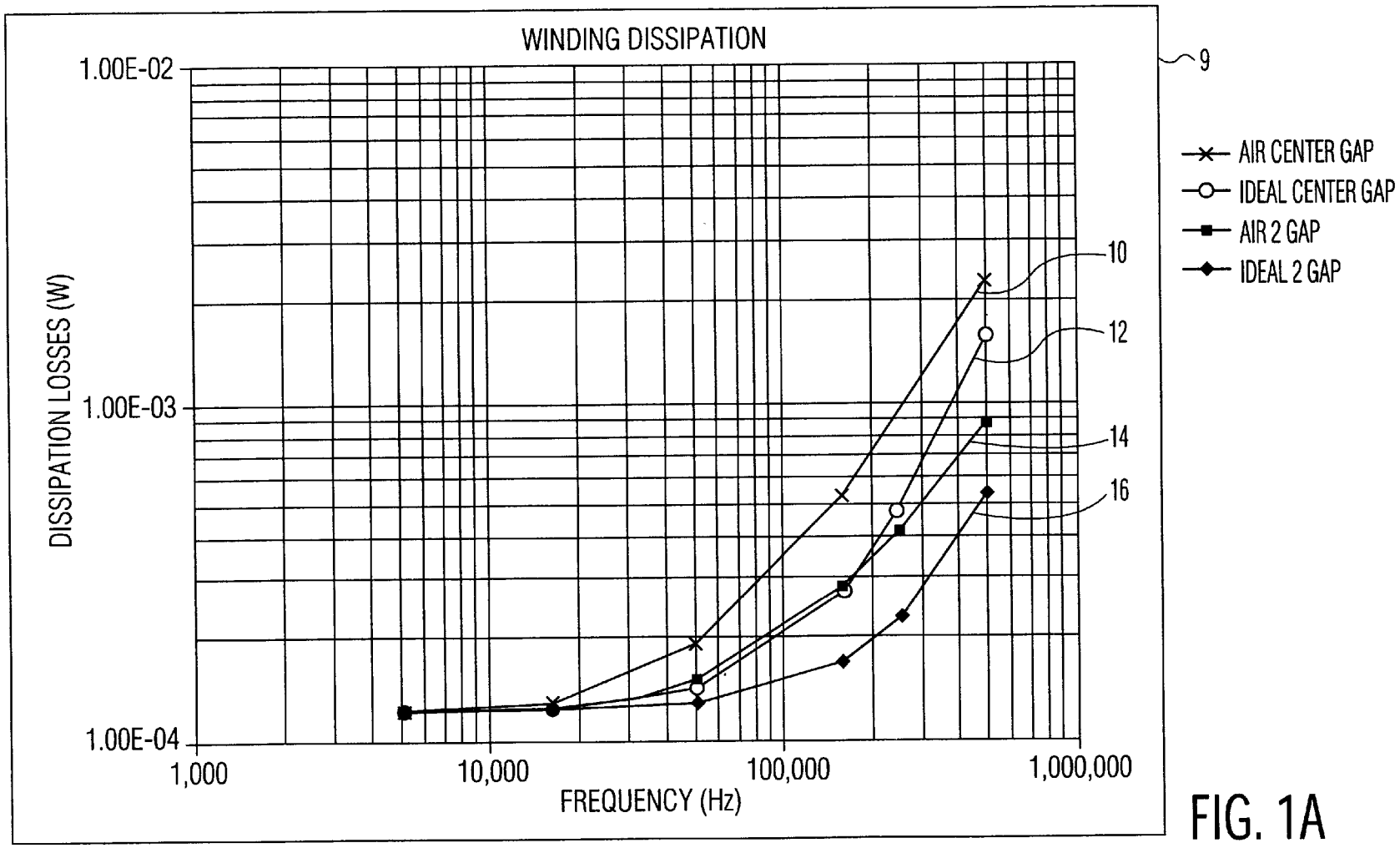
FIG. 1A is a graphical illustration of a winding dissipation function of magnetic components with various gap configurations plotted on dissipation losses vs. operating frequency graph.
Figure 1B:
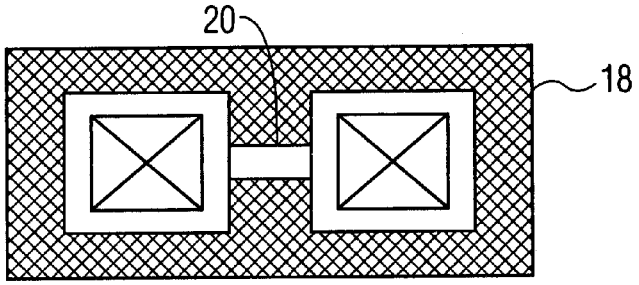
FIGS. 1B–1E are illustrations of cross sections of magnetic components showing carious core and winding arrangements.
Figure 1C:
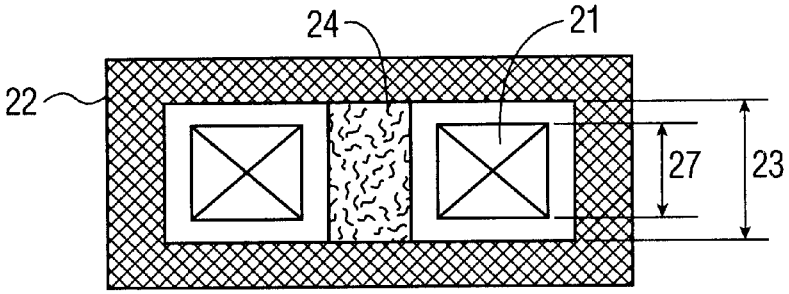
Figure 1D:
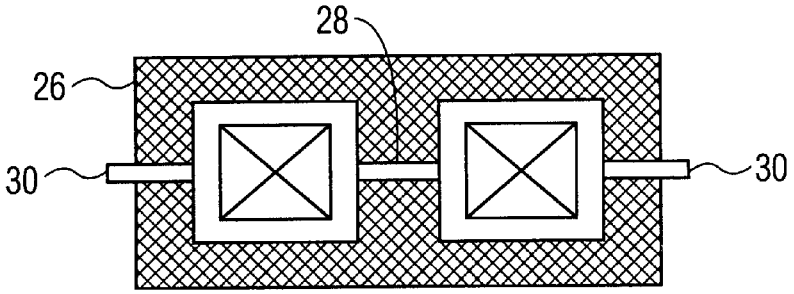
Figure 1E:
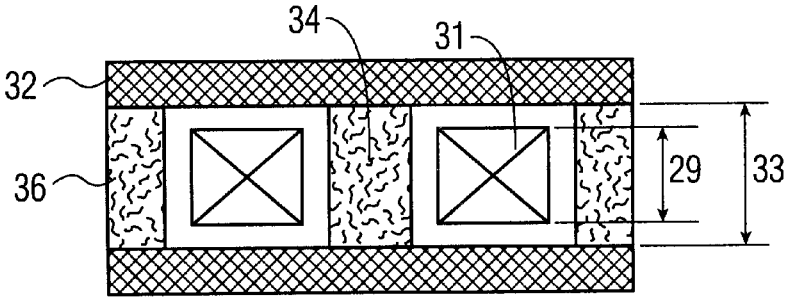

The present invention aims to minimize gap related eddy current losses. An improvement in gap distribution over the inner and outer core legs of the magnetic inductor is being contemplated to achieve that end. Such distribution will be referred to throughout the specification as "Ideal." Although the field strength in the distributed air gap volume is the same as that in the gap of a single gapped inductor, the mean field intensity of the inductor is halved and therefore its winding losses are reduced. This however brings about radiation from the gaps in the outer legs of the inductor, which increases the level of radiated EMI in the circuit.

FIG. 1 shows a graph of winding dissipation where dissipation loses are plotted against frequency changes. Curve 10 represents dissipation losses as frequency is increased, by a device 18 (FIG. 1B) that is formed with the air center gap 20. Curve 12 represents dissipation losses as frequency is increased, by a device 22 (FIG. 1C) that is formed with the Ideal center gap 24. Curve 14 represents dissipation losses as frequency is increased, by a device 26 (FIG. 1D) that is formed with the two air gaps 28, 30. The first air gap 28 is in the inner core leg, while the second gap 30 is in the outer core legs. Curve 16 represents dissipation losses as frequency is increased, by a device 32 (1E) that is formed with two Ideal center gaps 34, 36. The first air gap 34 is in the inner core leg, while the second gap 36 is in the outer core legs.

The inventive magnetic devices 22, 36 provide gapped areas 24, 34, 36 of the same heights 23, 33 as the windings 21, 31, but higher than 50% of the winding heights 27, 29. The energy stored due to build-up of the magnetic field, especially in planar magnetic components 22, 32, is sufficient to be used for a wide range of applications. To fine-tune the properties, the gaps 24, 34 may be filled with a low permeability potting material.

As can be ascertained from the graph 9, although the use of a center gapped core doubles the mean field in the winding area and thereby quadruples the winding losses, the EMI problem is herewith eliminated through the use of magnetic components comprising Ideal gaps. Furthermore, placing the gap in the middle of the core doubles the gap height 23, 33 compared to that of distributed gaps.

Figure 2:
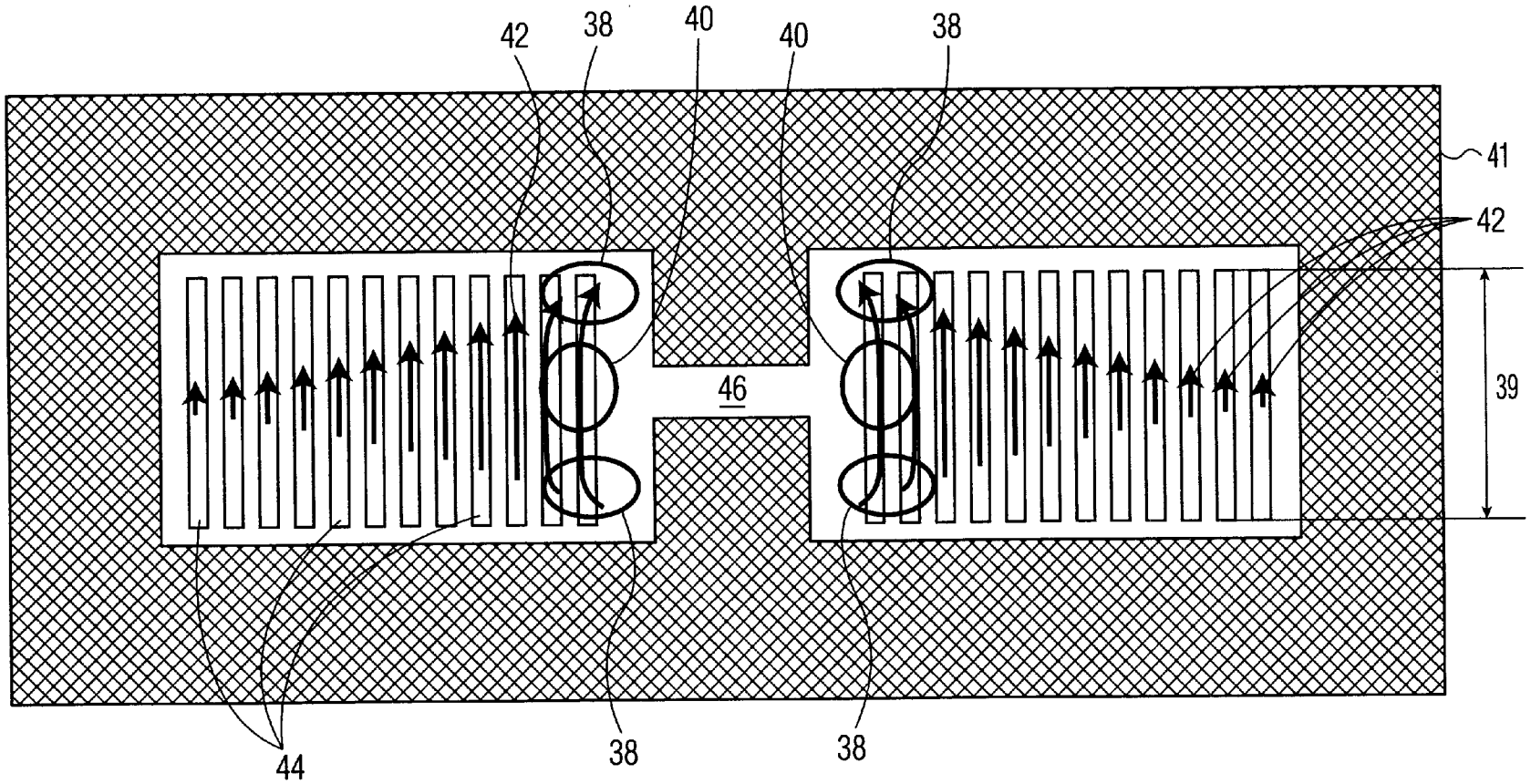
FIG. 2 is a pictorial illustration of a core and winding arrangement magnetic components of prior art.

FIG. 2 shows two different areas of losses 38, 40 in the foils close to the gap. The areas 38 on the top and on the bottom are caused by the gap related field distortion with dissipation losses due to non foil-field geometry. The areas 40 close to the H-field 46 are caused not to be parallel to the turn surfaces any more, creating considerable eddy current losses with dissipation losses due to local field enhancement due to gap. Arrows 42 display the direction of the local magnetic field. The cross section for the simple 12 turn magnetic component structure 41 shows the magnetic field build-up towards the center of the coil. Due to field fringing, the magnetic field is not parallel to the foil winds where the field is highest 38. The magnetic field close to the gap is very high, which is the source of extra losses indicated in that area 40.

To avoid these losses 38, 40, the height 39 of the winding 44 is decreased, or in other words, the gap height/winding height (G/W) ratio is increased. This way, the magnetic field 42 becomes progressively less distorted and the losses decrease accordingly. Losses 38, 40 immediately around the gap, are caused by gap related field enhancement. These losses 38, 40 may only be decreased by the lowering of the local H-field 46. To minimize the top/bottom losses, the G/W height ratio should preferably be higher than 50.

Figure 3A:
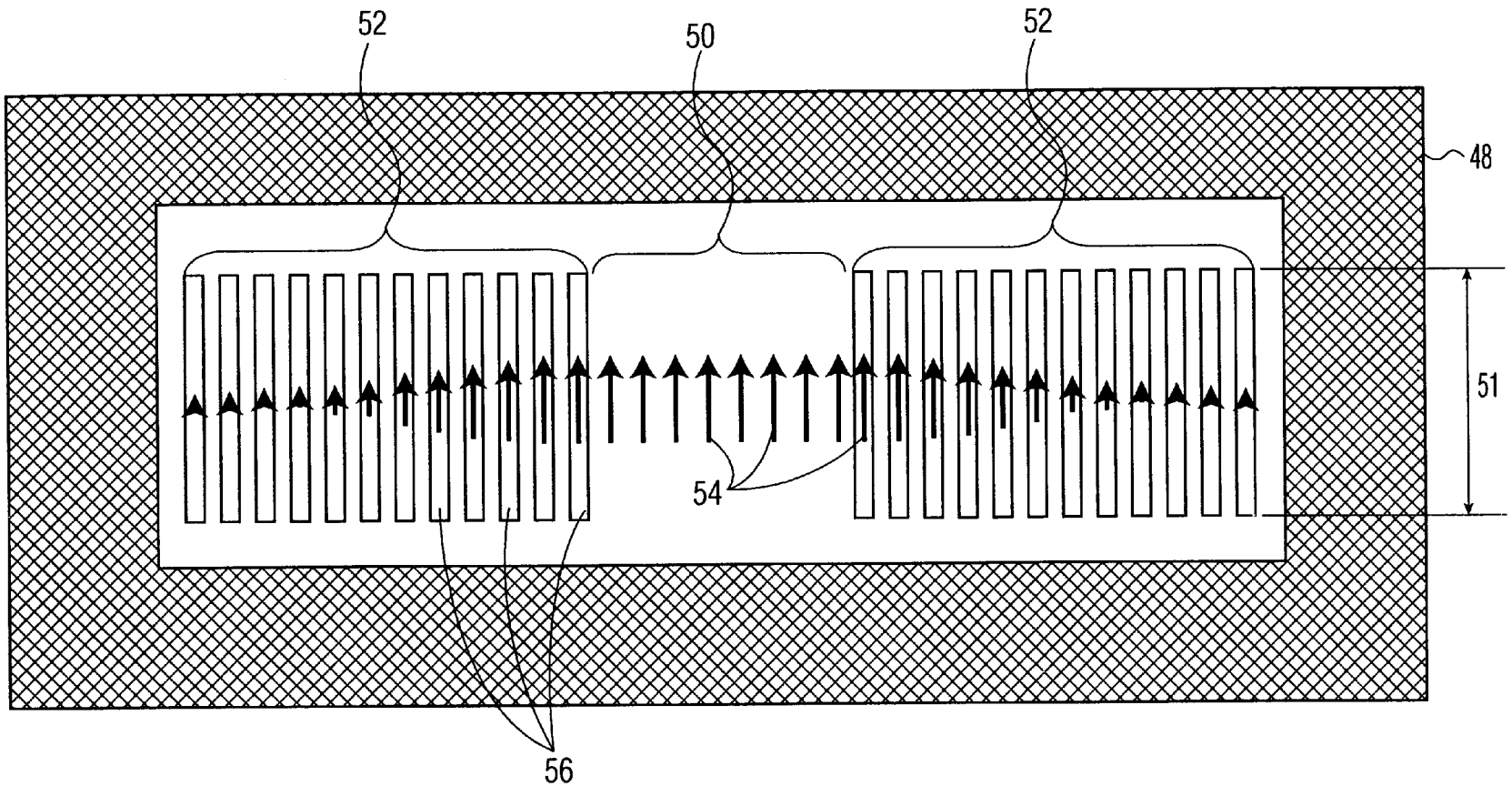
FIG. 3 is a pictorial illustration of a core and winding arrangement of magnetic components of the present invention.

Please note that the ideal field distribution may be obtained when the height of the center gap 50 equals the winding 52 window height 51. FIG. 3*a* shows the implementation of the structure of the magnetic component 48 without a center leg. The center gap 50 may be distributed over the total volume of the middle leg of the magnetic component's 48 core. Such construction of the magnetic component 48 guarantees the magnetic field distribution, where the field 54 is always parallel to the foil winds 56. When the height 51 of the winding window 52 is reduced, the reluctance of the structure decreases, which causes the energy stored in the magnetic component 48 to increase. This outcome makes planar magnetic component structures especially suited for this geometry. In this configuration the amount of energy stored, may be higher than in the geometry discussed above, while maintaining the ideal field direction close to the foil surfaces.

Figure 3B:
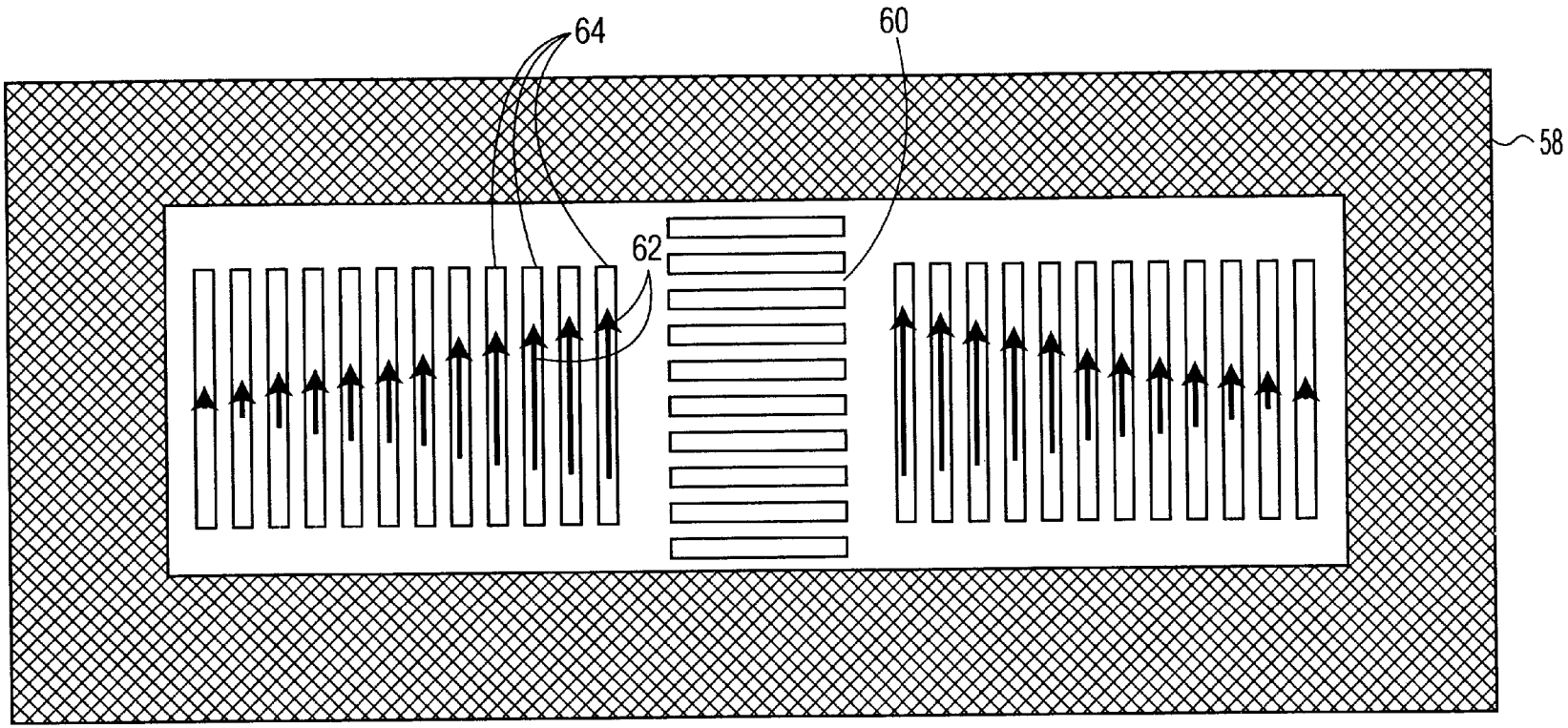

To use the whole center leg volume and to apply the distributed gap, the space in the coil may be filled with a low permeability material, such as any of the existing low permeability ferrite materials. Another option may be to make use of a stack of equally spaced parallel ferrite plates embedded in a polymer or other non-magnetic electrically isolating material. Both of these solutions require extra ferrite components that are relatively expensive. FIG. 3*b* shows the magnetic component 58 with a distributed gap 60 at the center of the core. Such distributed gap 60 guarantees the magnetic field distribution where the magnetic field 62 is always parallel to the foil winds 64. The present invention teaches the use of the distributed gaps 60 in planar, vertical windings. The use of composite materials in distributed gaps 60 and the use of single particle layers in composite distributed gap systems is novel as well. Please note that due to the lower magnetic reluctance in the magnetic component 58 as compared to the the magnetic component 48 (FIG. 3*a*), the inductance of this structure of the magnetic component 58 will be higher.

An alternative solution in forming the magnetic component 58 may be to make use of low permeability polymer magnetic composite materials. These materials may be made in the proper relative permeability range of 1 to 30. Such a potting material would serve the following functions:

a. Enable the setting of the desired inductance of the components during assembly.

b. Provide electrical isolation.

c. Increase creepage distances.

d. Provide a high thermal conductivity of the magnetic component.

The proposed low permeability composite materials are unlike conventional magnetic core materials that are based on the use of brittle, densely sintered ceramic or metallic materials. The low permeability composite materials are a combination of polymer materials and fine-grained magnetic materials. The advantage of the new magnetic composite material is in that it may be produced in any shape or form through the use of plastic extrusion and molding techniques. The total volume within the coil may be conveniently used to set the inductance of the component by injecting the potting material.

The disadvantage of the magnetic composite material is that it has a low relative permeability, typically 10–30, as can be seen from the Siemens-Matsushita data sheet of Ferrite Polymer Composites. Permeability is the property of a magnetizable substance that determines the degree to which the substance modifies the magnetic flux in the region occupied by it in a magnetic field. Magnetic flux may be shown by lines of force, whereby the density of the flux lines is a measure of local magnetic induction. Magnetic induction is a process by which a magnetizable body becomes magnetized when disposed in a magnetic field or in the magnetic flux set up by a magnetomotive force. The further disadvantage is that the magnetic composite material saturates at low flux levels and shows a relatively high flux density-dependent dissipation level.

So far, these magnetic composite materials have been used mainly for Electro-magnetic-interference (EMI) shielding applications. See, for example, the materials described in U.S. Pat. No. 5,714,102 and the Tokin Flex-Suppressor and Siemens-Matsushita products, e.g., C302, C303, currently available on the market.

The use of the magnetic composite materials in transformers and inductors with the aim of transferring energy in power applications is further frustrated by the low permeability and the low flux densities allowed to keep dissipation levels low. An example of a possible ferrite composite based design of a transformer is described in European Patent application No. EP 99/04763, filed on Jul. 22, 1998.

Yet another way to provide the distributed gap and to increase the inductance of a coil is to make use of a multi-layered structure in the gap area consisting of alternating, thin, non-magnetic and magnetic layers. The magnetic layers may be made of the composite materials mentioned above. To achieve optimal results the thin polymer/magnetic material should be very thin with thickness close to that of the magnetic particle diameter. The polymer spacing layers may have a thickness equal to the particle diameter or higher. Disks may be pressed from the multi-layer polymer ferrite composite foil to be used as low loss distributed gap inserts in the middle part of the coil.

Figure 4A:
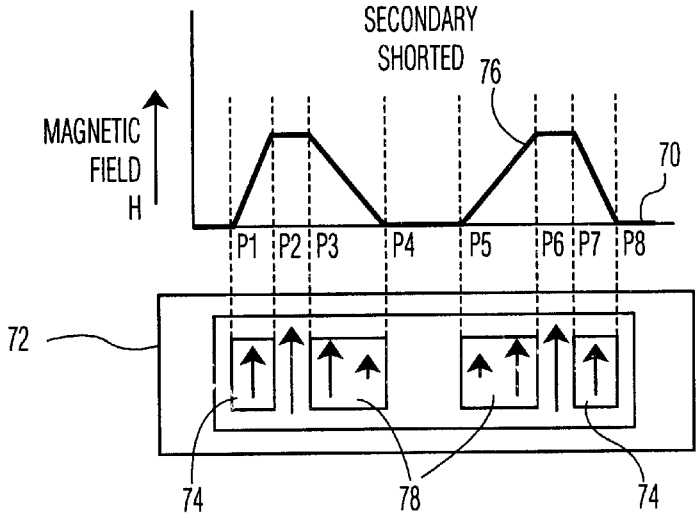
FIG. 4 is a graphical illustration of a vertically wound planar gapped magnetic component in association with a graph of a magnetic field distribution.
Figure 4B:
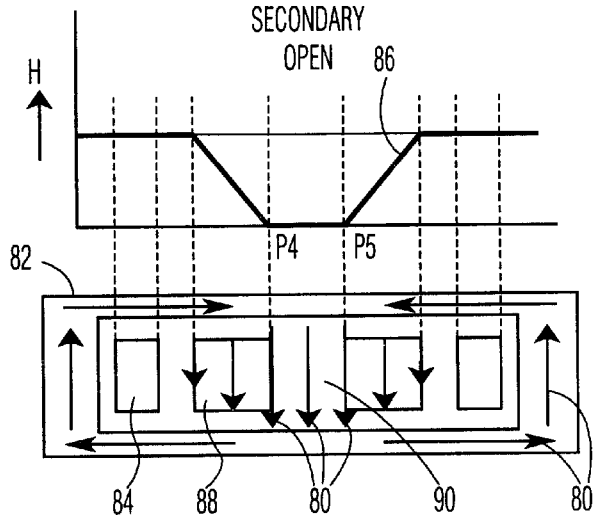

The inventive concept of the magnetic component without a center core leg may be used in devices such as transformers with integrated inductance. A vertically wound planar transformer may be formed without a center core leg as shown in FIG. 4. Arrows in FIG. 4 indicate the direction of the magnetic field (H). FIG. 4*a* shows a graph 70 of the direction of the magnetic field in the magnetic component 72 for a fully loaded and effectively shorted secondary coil 74. The magnetic field H 76 builds up in the primary coil 78 from a point p5, reaching its maximum at point p6. The maximum build up of the magnetic field H 76 is maintained in between the primary 78 and the secondary 74 coils between point p6 and p7. The magnetic field H 76 decreases between the points p7 and p8 in the secondary coil 74. This behavior of the magnetic field in the transformer is called the leakage flux. Under these conditions, the leakage flux is parallel to the foils of the magnetic component 72.

For a practical transformer, there may always be a small fraction of the total leakage flux that may not be coupled to the secondary coil 74. This leakage flux may circle the core in a manner shown in FIG. 4b and indicated by arrows 80. Under no load conditions, the magnetic component or the transformer 82 behaves essentially as if it were an inductor. The primary coil 88 generates a magnetic field H 76 and the energy is stored in the area 90. The area 90 is located between points p4 and p5, in the center of the primary coil. This area 90 is essentially a gap with a height equal to the height of the winding window (as shown by height 51 (FIG. 3*a*). Under these conditions the magnetic field is parallel to the foils.

Figure 4C:
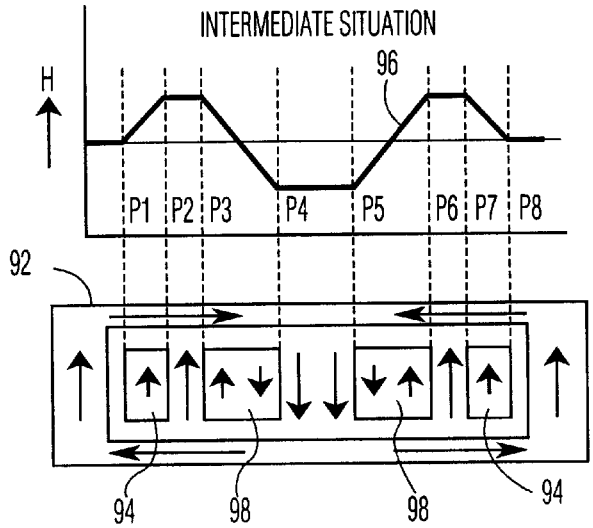

In the intermediate case, shown in FIG. 4*c*, part of the magnetic field H 96 builds up in the primary coil 98. This buildup is transferred to the secondary coil 94, and part of it is stored. As with the previous example, the magnetic field will remain parallel to the winding foils under all conditions.

EXAMPLE

As an example please consider a vertically wound planar transformer that performs favorably in a 300–500 kHz resonant power supply in comparison to a conventional wire wound transformer in terms of size and eddy current losses. The transformer may consist of the primary coil having 43 turns and a multiple output secondary coil having a comparable number of turns. Both, the primary and the secondary coils are foil wound with foil of 20 um thickness. The metal foil height may be 5 mm.

The isolation between turns may consist of polyethene terephthalate (PET) foil with a thickness of 8 um and a height of 6 mm. In order to meet safety requirements regarding mains, isolation between primary and secondary coils and the core and between the primary and secondary coils themselves, the primary and secondary coils may be encapsulated by appropriate insulating material, for example plastic. Such approach may also provide proper creep distances between the primary and secondary sides of the transformer. Contacts may be led out of the transformer structure on a long side of the transformer, where there may be no obstruction by the outer core legs. Primary and secondary coils may be spaced by a distance of 2.3 mm. This is the area where the major part of the transformer leakage field is present. With a winding window height of 6 mm a transformer with a leakage inductance of 26 uH and a primary inductance of 61 uH may be realized.

Typically, depending on the application, foil thickness may be chosen from 0.1 um to 0.5 mm for primary and secondary coils. Moreover, primary and secondary coils may not necessarily be of the same thickness. Even within primary and/or secondary coils one may opt for various metal thickness when there are multiple inputs, i.e., more than 2. The thickness of the insulator layer may also be application dependent and may vary between 0.25 um and 0.2 mm, depending on the degree of isolation needed. The thicker insulating layer may preferentially be used to guarantee isolation between primary and secondary coils. The distance between the primary and secondary-coils may be determined by the amount of leakage desired and typically seals the surface area in between the primary and secondary coils.

COMPOSITES

The use of the composite material considerably reduces fringe fields and thereby transformer loses. To further reduce magnetic loses suffered by ferrite-polymer composites due to local flux densities (B), nano-crystaline Fe or amorphous Co-polymer composites having much higher flux densities, e.g., 1.3 T, may be used. At conventional transformer operating conditions at frequencies of ~100 kHz and induction levels around 0.5 T, the hysteresis loss, which is the relationship of the flux density and the magnetizing force characteristics of the core material, and the eddy current loss dominate the dissipation of magnetic materials. Therefore it is desirable to use materials having high flux densities and which are insulating at these conditions.

Ferrites are normally used for transformer applications because of their insulating qualities. However, ferrites only have a spontaneous induction flux density of 0.5 T. When ferrites are dispersed in polymers, these composites exhibit high magnetic losses due to high local fields that arise for use as dispersed air gap materials. Soft magnetic materials such as nano-crystalline Fe-alloys or amorphous Co-alloys mixed in polymers, form much more suited composites for distributed air-gap materials as they have a much higher flux density of ~1.3 T. This flux density exceeds the maximum of 0.5 T induction standing of a ferrite-based transformer gap. The embedding in the polymer assures that eddy currents will be impeded so that these composites, based on metallic soft magnetic materials, can still be used up to frequencies of 100–400 kHz.

Based on the discussion above, it is advantageous to provide the distributed gap by using a multi-layered structure in the gap area consisting of alternating thin non-magnetic and magnetic layers. This way a more homogeneous flux-distribution may be attained in the gap area. Moreover, the possibility of occurrence of high local flux fields that tend to rapidly increase the loss P as P ▒ $B^2$ is limited.

The magnetic layers may be made of the composite materials mentioned above. To achieve optimal results the magnetic-polymer composite material may have a thickness close to the particle diameter. The polymer spacing layer may have a thickness equal to that of the diameter of the magnetic particle or higher. The desired form to fill the gap area may be pressed from a multi-layer polymer composite foil and inserted in the gap area of conventional transformers. Moreover, due to the limited amount of alloy or ferrite powder materials needed for distributed air gap materials in transformer which are otherwise made of ferrite ceramics, the cost of materials is minimal.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims.

Having thus described our invention, what we claim as new, and desire to secure by Letters Patent is:

1. A vertically wound planar magnetic component comprising:

a winding structure;

a magnetic gap area, a height of said magnetic gap area is more than 50% of a height of said winding structure; and a winding window, said winding window being of said height of said magnetic gap area.

2. The magnetic component of claim 1, wherein said magnetic gap area is formed with low permeability composite material.

3. The magnetic component of claim 2, wherein said magnetic component is formed without a center core leg.

4. The magnetic component of claim 3, wherein said magnetic component is an inductor.

5. The magnetic component of claim 4, wherein said magnetic component is a transformer.

6. A vertically wound planar transformer comprising a gap area for attaining a homogeneous flux-distribution in said gap area, said gap area comprising a multi-layered structure having alternating first and second layers wherein said first layer comprises a thin non-magnetic material and said second layer comprises a thin magnetic material, said second layer being formed of a soft magnetic composite material with high magnetization value where said soft magnetic composite material is selected from the group consisting of a nano-crystalline Fe polymer composite and amorphous Co-polymer composite.

* * * * *